US008070443B1

(12) United States Patent
Liang

(10) Patent No.: US 8,070,443 B1
(45) Date of Patent: Dec. 6, 2011

(54) TURBINE BLADE WITH LEADING EDGE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 409 days.

(21) Appl. No.: 12/419,483

(22) Filed: Apr. 7, 2009

(51) Int. Cl.
*F01D 5/18* (2006.01)

(52) U.S. Cl. ..... 416/97 R; 415/115; 416/1; 416/92; 416/96 R

(58) Field of Classification Search ..... 415/115; 416/1, 92, 96 R, 97 R
See application file for complete search history.

(56) References Cited

U.S. PATENT DOCUMENTS 5,813,835 A * 9/1998 Corsmeier et al. ..... 416/97 R
5,931,638 A * 8/1999 Krause et al. ..... 416/97 R
6,036,441 A * 3/2000 Manning et al. ..... 416/97 R
7,293,961 B2 * 11/2007 Lee et al. ..... 416/96 R

* cited by examiner

*Primary Examiner* — Asok Sarkar
(74) *Attorney, Agent, or Firm* — John Ryznic

(57) ABSTRACT

A turbine rotor blade with a leading edge region cooled by a series of impingement cooling cavities that repeats from near the platform to the blade tip to provide impingement cooling for the leading edge without a loss of cooling air flow volume. A cooling supply cavity delivers cooling air to a series of impingement cavities located on the pressure side, the leading edge and the suction side of the airfoil in a series flow. The spent cooling air from the series then flows up into the next series of impingement cavities to provide impingement cooling to the next section of the leading edge. The cooling air flows through multiple series of impingement cooling cavities until the blade tip, which then discharges the spent impingement cooling air through tip cooling holes.

14 Claims, 3 Drawing Sheets

TURBINE BLADE WITH LEADING EDGE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to a turbine rotor blade with leading edge cooling.

2. Description of the Related Art Including Information Disclosed Under 37 CFR 1.97 and 1.98

A gas turbine engine includes a turbine section with one or more rows or stages of rotor blades that react with a high temperature gas flow in order to drive the compressor and, in the case of an aero engine a fan, or in the case of an industrial gas turbine engine, an electric generator. Increasing the turbine inlet temperature will increase the efficiency of the engine. However, the highest turbine inlet temperature is dependent on the material properties and the amount of cooling provided to the parts exposed to the high temperatures. The limiting parts are the first stage airfoils which include the first stage blades and the first stage vanes.

The leading edge of an airfoil is exposed to the highest temperature gas flow which directly hits the stagnation point of the leading edge. Prior art methods of cooling the leading edge include a combination of impingement cooling of the backside wall followed by film cooling of the external wall. FIG. 1 shows a prior art turbine blade with a 3-pass aft flowing serpentine flow cooling circuit in which the first leg 11 is located adjacent to a leading edge impingement cavity 15 and is connected to it through a row of metering and impingement holes 14 formed within the rib that separates the first leg 11 from the impingement cavity 15. The serpentine circuit also includes a second leg 12 and a third leg 13 that is positioned adjacent to the trailing edge region in which a row of exit holes 16 are formed to discharge cooling air from the serpentine circuit. Spent cooling air in the impingement cavity 15 exits the blade through one or more tip cooling holes at the blade tip. Tip cooling holes are also connected to the tip turn in the serpentine circuit to discharge some of the cooling air through the blade tip than flows through the serpentine circuit. For an airfoil with low cooling flow design, especially low leading edge impingement flow design, the radial spacing for the leading edge impingement hole 14 will be larger than the impingement jet can be spread out within the inner surface of the leading edge corner. This will induce a region with low impingement cooling area within the inner surface of the leading edge corner. This will form an area with low impingement cooling within the inner surface of the leading edge corner. This will yield a hot spot in-between the impingement hole 14 and uneven cooling for the blade leading edge impingement cooling cavity 15. In addition, cross flow effect induced by the multiple hole impingement will lower the impingement heat transfer performance. In the prior art blade design of FIG. 1, some of the cooling air from the serpentine flow circuit is diverted into the leading edge impingement cavity 15 for cooling to the leading edge wall.

BRIEF SUMMARY OF THE INVENTION

It is an object of the present invention to provide for a turbine rotor blade with a low cooling flow design for the leading edge of the blade.

It is another object of the present invention to provide for a turbine rotor blade of the low cooling flow design for the leading edge in which the hot spot issues within the leading edge cavity of the prior art rotor blade are eliminated.

It is another object of the present invention to provide for a turbine rotor blade of the low cooling flow design for the leading edge in which the cross flow effects within the leading edge cavity of the prior art rotor blade are eliminated.

It is another object of the present invention to provide for a turbine rotor blade with a leading edge cooling circuit separate form the cooling circuit for the remaining sections of the blade.

The above objectives and more are achieved with the leading edge multiple impingement series of cooling cavities for the turbine rotor blade of the present invention. The blade includes a leading edge region in which the series of multiple impingement cavities are formed. Each series of multiple impingement cavities includes a cooling air supply cavity located in a middle location, a first impingement cavity located on the suction side wall, a second impingement cavity located on the leading edge wall and a third impingement cavity located on the pressure side wall. Cooling air from the supply cavity flows through a first impingement holes and into the first impingement cavity, then through a second impingement holes and into the second impingement cavity, and then through a third impingement hole and into the third impingement cavity. From the third impingement cavity, the cooling air then flows into the next series of multiple impingement cavities located above the preceding multiple impingement cavities. This series of multiple impingement cavity cooling is repeated from the platform section of the leading edge region to the tip region of the blade to provide a low flow cooling for the leading edge of the blade. The spent impingement cooling air is then discharges through a blade tip cooling hole.

In another embodiment, the flow direction of the multiple impingement cooling circuit can be such that the first impingement cavity is located on the pressure side wall and the third impingement cavity is located on the suction side wall.

DETAILED DESCRIPTION OF THE INVENTION

Figure 1:
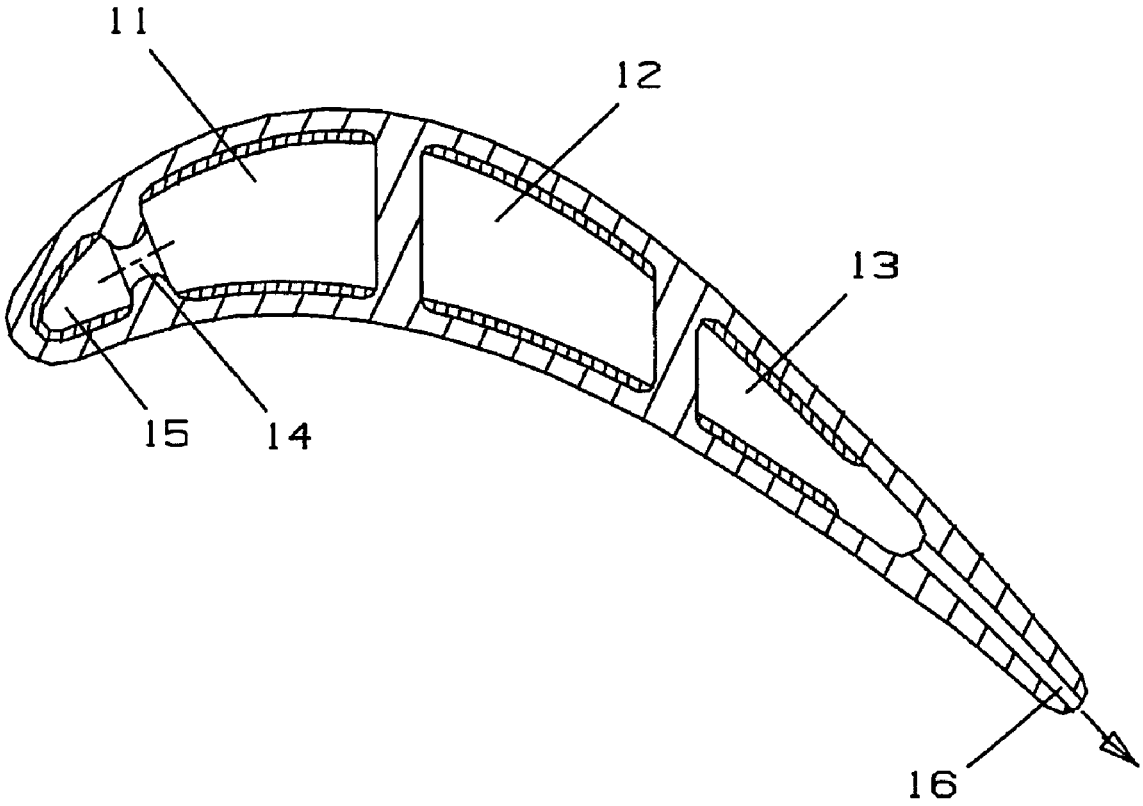
Fig 1 Prior Art
FIG. 1 shows a cross section view from the top of a prior art turbine rotor blade with a low cooling flow design.
Figure 2:
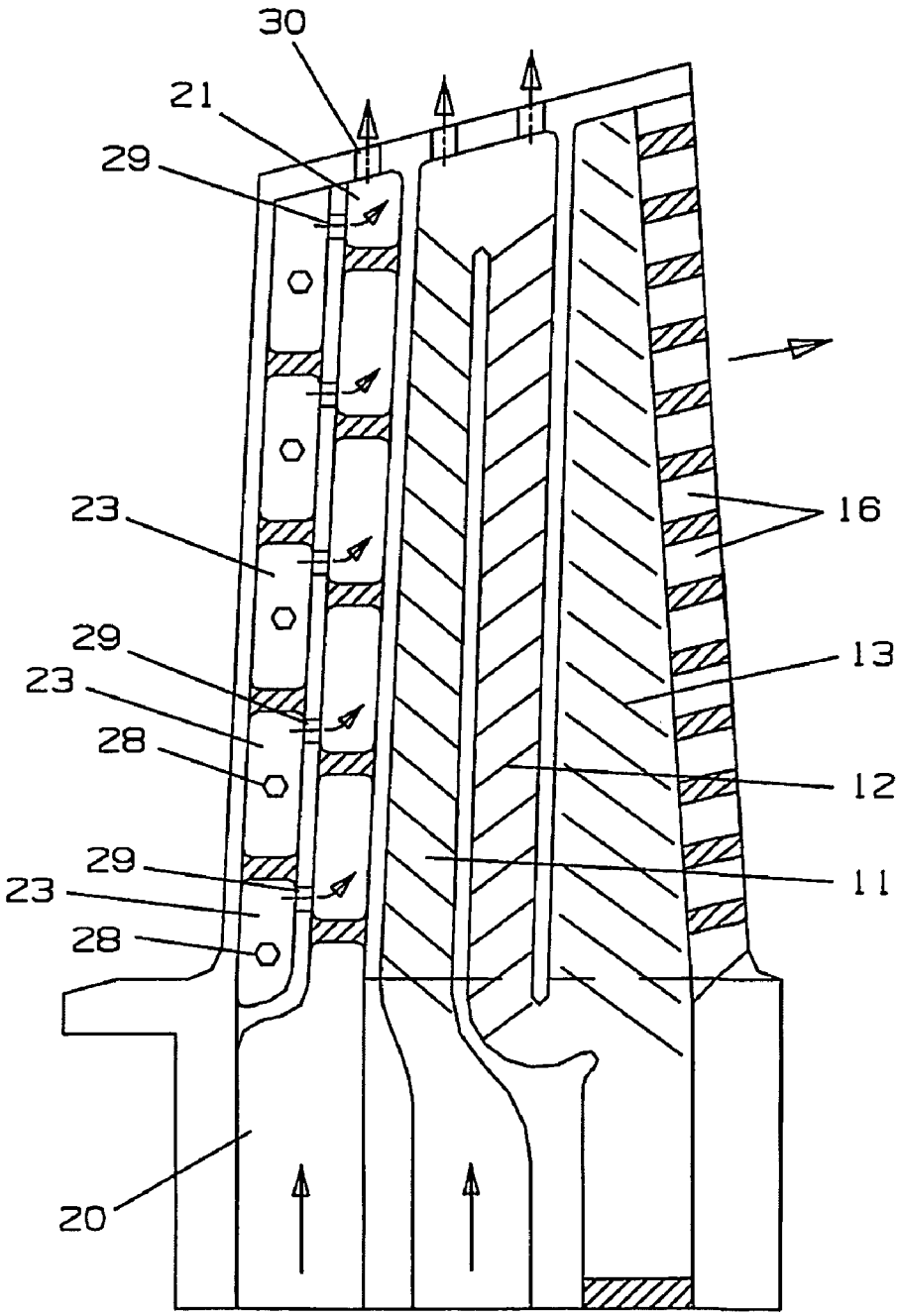
FIG. 2 shows a cross section view from the side of the low cooling flow circuit of a blade for the present invention.

The present invention is a turbine rotor blade for an industrial gas turbine engine with a low cooling flow leading edge cooling circuit. However, the cooling circuit can be used in stator vanes or in an aero engine as well. FIG. 2 shows a cross section view of the rotor blade of the present invention and includes a 3-pass aft flowing serpentine cooling circuit with a first leg 11 positioned adjacent to a leading edge region of the airfoil, a second leg 12 and a third leg 13 that is located adjacent to the trailing edge region of the airfoil. A row of cooling air exit holes 16 are formed along the trailing edge and are connected to the third leg 13 of the 3-pass serpentine. The tip turn in the 3-pass serpentine circuit is also connected to tip cooling holes to discharge some of the serpentine flow cooling air through the blade tip.

The leading edge region of the blade of the present invention is cooled by a series of multiple impingement cavities that extend the length of the airfoil in the spanwise direction. A cooling supply cavity 20 formed in the blade root supplies the pressurized cooling air from a source external to the blade such as from the compressor. The cooling air supply cavity 20 in the root merges into a first cooling air supply cavity 21 that is positioned in the middle of the leading edge region between two other impingement cavities. The series of multiple impingement cavities along the leading edge region is separated from the serpentine flow cooling circuit in that the cooling air from one does not mix with the cooling air of the other. These are two separate blade internal cooling passages.

The cooling air supply cavity 21 is connected to a suction side impingement cavity 22 by a first metering and impingement hole 26. The suction side impingement cavity in this embodiment forms the first impingement cavity 22 in the series. A leading edge impingement cavity 23 forms a second impingement cavity 23 and is connected to the first impingement cavity 22 through a second metering and impingement hole 27. A pressure side impingement cavity 24 forms a third impingement cavity 24 and is connected to the second impingement cavity 23 through a third metering and impingement hole 28. The third impingement cavity 24 is connected to the next cooling air supply cavity 21 located above the previous cooling air supply cavity.

The series of first and second and third impingement cavities 22-24 are repeated in the blade spanwise direction from the platform area to the blade tip area by following the same series of impingement cooling. The lowest third impingement cavity 24 flows into the cooling air supply cavity 21 located above the first cooling air supply cavity and then into another series of first, second and third impingement cavities 22-24 to provide impingement cooling to the backside walls of the leading edge region of the airfoil. The last third impingement cavity 24 discharges the spent impingement cooling air into the last cooling air supply cavity 21 and then discharges the cooling air through a blade tip cooling hole 30.

The leading edge cooling air supply channel is subdivided into multiple impingement cavities in the spanwise direction. In each impingement cavity includes a spent air return hole and an impingement hole that directs the cooling air to impinge onto the backside surface of the blade leading edge inner wall. A partition rib 31 for the cooling air supply channel is offset from the blade leading edge compartment impingement cavities. Partition ribs 32 separate the three impingement cavities (22, 23, 24) form one another. The design of the present invention allows the spent air return to the next cooling air supply cavity for a continuation of the multiple impingement process for the blade leading edge. The series of multiple impingement cooling cavities formed within the leading edge region forms a separate cooling air passage through the blade than does the serpentine flow cooling circuit that cools the other sections of the blade.

In operation, cooling air is supplied through the first airfoil leading edge cooling air supply cavity 21 and then through the first impingement hole 26 and into the first impingement cavity 22 to provide impingement cooling to the backside surface of the suction side wall. Spent cooling air from the first impingement cavity 22 then flows through the second impingement hole 27 and into the second impingement cavity 23 to provide impingement cooling to the backside surface of the leading edge wall. Spent cooling air in the second impingement cavity 23 then flows through the third impingement hole 28 and into the third impingement cavity 24 to provide impingement cooling for the backside surface of the pressure side wall. The spent cooling air in the third impingement cavity 24 then flows through the spent air return hole 29 and into the next supply cavity 21 located just above the previous supply cavity 21. from this cooling air supply cavity 21, the cooling air flows through the next series of first impingement cavity 22 followed by second impingement cavity 23 and third impingement cavity 24 to provide impingement cooling to the backside surfaces of the three sections of the leading edge region. This series of impingement cooling is repeated along the entire airfoil leading edge portion toward the blade tip.

Figure 3:
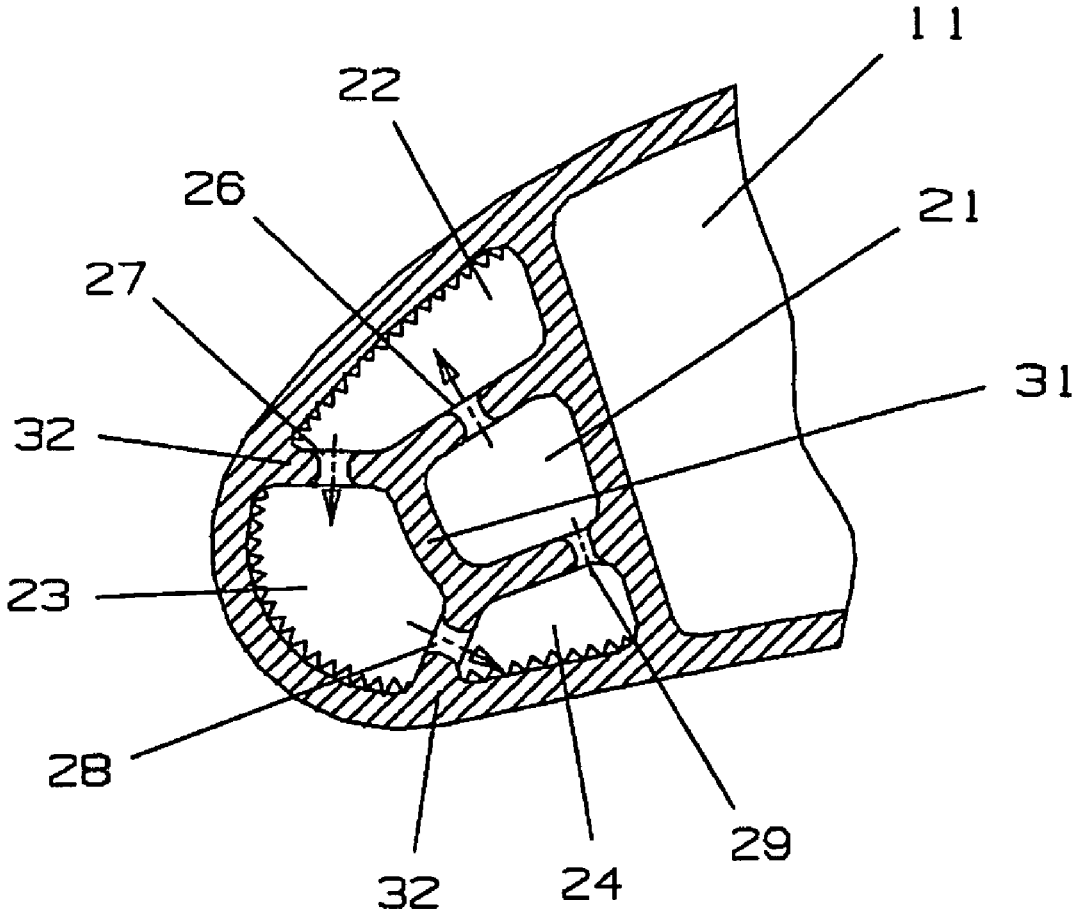
FIG. 3 shows a cross section detailed view from the top of the leading edge multiple impingement circuit of the present invention.

In another embodiment of the present invention, the first impingement cavity can be located on the pressure side wall and the third impingement cavity located on the suction side wall which is the reverse of the first embodiment as shown in FIG. 3. In still another embodiment, the series can reverse between the first two embodiments in which one stack of impingement cavities can start on the pressure side and the next stack above can start on the suction side and therefore alternate in this manner along the leading edge of the airfoil.

The multiple impingement cooling circuit of the present invention allows for the use of total blade leading edge cooling air for the multiple impingement cooling arrangement and maximizes the usage of cooling air for a given airfoil inlet gas temperature and pressure profile. Also the use of total cooling for repeating the impingement process generates extremely high turbulence level for a fixed amount of coolant flow and thus creates a high value of internal heat transfer coefficient. As a result, the multiple impingement cooling circuit yields a higher internal convective cooling effectiveness than the prior art single pass impingement used in the turbine airfoil cooling design.

Major design features of the series of multiple impingement cooling cavities of the present invention are described below. The blade leading edge cooling design includes a series of impingement compartments with built-in rough surfaces for internal heat transfer augmentation. The rough surface can be formed by micro pin fins, small extended surfaces or concave shaped dimples.

Internal cooling impingement jet velocity and heat transfer performance for each individual impingement cavity is controlled by the spacing of the impingement distance for maintaining jet arrival velocity and pressure ratio across the impingement hole for each individual impingement cavity.

Individual multiple impingement cavities are in communication with each other in series and are designed based on the airfoil leading edge external heat load onto the airfoil pressure and suction sides.

Total cooling air is used for the impingement to each individual impingement cavity (no cooling air is lost, for example, through film cooling holes or bled off for other cooling) which therefore yields a higher level of internal impingement heat transfer performance than the prior art impingement cooling design which subdivides the total cooling air throughout the entire airfoil inner surface.

The individual impingement cavity can be designed for tailoring the airfoil external heat load onto each individual section of the turbine airfoil. This can be achieved by changing the impingement compartment width which translates into altering the impingement mass flux onto the inner surface of each individual compartment cavity and therefore generate the impingement cooling level to achieve the desired airfoil metal temperature. Controlling the metal temperature is important in order to prevent hot spots that lead to erosion damage of the blade and shortens the part life.

In the prior art impingement cooling design with cooling supply channel, the supply channel bleeds off cooling air and subsequently reduces the channel flow heat transfer coefficient. However, for the current multiple supply channels, the cooling air supply cavities retains the same amount of cooling air flow in each individual supply cavity which is also shielded from the pressure side and the suction side impingement cavities.

Multiple use of cooling air provides a higher overall cooling effectiveness level.

The single impingement jet cooling with multiple impingement cooling cavities eliminates the cross flow effect on impingement to achieve a much higher impingement heat transfer level for a given flow rate.

I claim the following:

1. An air cooled turbine rotor blade comprising:

a main airfoil body;

a serpentine flow cooling circuit to provide cooling for the main airfoil body;

a leading edge region with a cooling air supply cavity located between a suction side impingement cavity and a pressure side impingement cavity and a leading edge impingement cavity;

an impingement holes opening into each of the impingement cavities; and, the impingement cavities being connected in series such that cooling air supplied to the cooling air supply cavity flows through the three impingement cavities in series.

2. The air cooled turbine rotor blade of claim 1, and further comprising:

the cooling air supply cavity is connected to the suction side impingement cavity, and then the leading edge impingement cavity and then the pressure side impingement cavity.

3. The air cooled turbine rotor blade of claim 1, and further comprising:

the cooling air supply cavity is connected to the pressure side impingement cavity, and then the leading edge impingement cavity and then the suction side impingement cavity.

4. The air cooled turbine rotor blade of claim 1, and further comprising:

the blade leading edge region includes a stack of multiple impingement cavities extending in a spanwise direction; and, the last impingement cavity in one series of multiple impingement cavities being connected to a supply cavity for the next series of multiple impingement cavities.

5. The air cooled turbine rotor blade of claim 4, and further comprising:

the stack of multiple impingement cavities forms a series of flow in a direction toward the blade tip.

6. The air cooled turbine rotor blade of claim 4, and further comprising:

the stack of multiple impingement cavities are not connected to any film cooling holes such that the total cooling air flow through a bottom stack of impingement cavities flows through a top stack of impingement cavities.

7. The air cooled turbine rotor blade of claim 1, and further comprising:

the series of multiple impingement cooling cavities is fluidly separate from the serpentine flow cooling circuit.

8. The air cooled turbine rotor blade of claim 1, and further comprising:

the impingement cavities are not connected to any film cooling holes.

9. The air cooled turbine rotor blade of claim 1, and further comprising:

the impingement holes are metering and impingement holes directed to discharge a jet of impingement cooling air against a backside surface of the airfoil wall.

10. The air cooled turbine rotor blade of claim 1, and further comprising:

the impingement cavities include a roughened surface to promote turbulent flow of impingement cooling air within the impingement cavity.

11. A process for cooling a turbine rotor blade comprising the steps of:

supplying pressurized cooling air to a supply cavity located in a leading edge region of the blade;

impinging the cooling air onto a backside surface of one of the pressure side or the suction side wall;

impinging the cooling air onto a backside surface of a leading edge wall;

impinging the cooling air onto a backside surface of the other of the pressure side or the suction side wall;

passing the collected cooling air through a series of pressure side and leading edge and suction side impingement cavities to provide impingement cooling of a different section of the leading edge; and, collecting the spent impingement cooling air into a different cooling air supply cavity located in the leading edge region of the blade.

12. The process for cooling a turbine rotor blade of claim 11, and further comprising the step of:

passing the cooling air through the series of leading edge impingement cavities without discharging any cooling air through film cooling holes.

13. The process for cooling a turbine rotor blade of claim 11, and further comprising the step of:

separating the cooling air for the leading edge region from the cooling air of a remaining section of the blade so that the cooling air for the leading edge region does not mix with any other cooling air within the blade.

14. The process for cooling a turbine rotor blade of claim 11, and further comprising the step of:

discharging the impingement cooling air from the last series of leading edge impingement cavities through a blade tip cooling hole.

* * * * *